US008652734B2

(12) United States Patent
Cardoso et al.

(10) Patent No.: US 8,652,734 B2
(45) Date of Patent: Feb. 18, 2014

(54) LOW DENSITY TONER FOR OPTIMAL IMAGE QUALITY AND PERFORMANCE LATITUDE

(75) Inventors: George Cunha Cardoso, Webster, NY (US); Rachael McGrath, Churchville, NY (US); Dale Mashtare, Simpsonville, SC (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/110,730

(22) Filed: May 18, 2011

(65) Prior Publication Data

US 2012/0295194 A1 Nov. 22, 2012

(51) Int. Cl.
*G03G 9/00* (2006.01)

(52) U.S. Cl.
USPC ..... 430/110.2; 430/110.1

(58) Field of Classification Search
USPC ..... 430/108.1, 110.1, 110.2, 110.3
See application file for complete search history.

(56) References Cited

U.S. PATENT DOCUMENTS

| | | | | |
|---|---|---|---|---|
| 5,643,673 | A * | 7/1997 | Hou | 428/402.24 |
| 5,948,582 | A * | 9/1999 | Nakamura et al. | 430/110.3 |
| 7,250,240 | B2 * | 7/2007 | Tosaka et al. | 430/108.1 |
| 7,887,984 | B2 | 2/2011 | Nair et al. | |
| 2009/0098288 | A1 | 4/2009 | Massa et al. | |
| 2009/0098382 | A1 * | 4/2009 | Massa et al. | 428/402.24 |

FOREIGN PATENT DOCUMENTS

| | | |
|---|---|---|
| JP | 2000-019775 | 1/2000 |

* cited by examiner

*Primary Examiner* — Stewart Fraser
(74) *Attorney, Agent, or Firm* — MH2 Technology Law Group LLP

(57) ABSTRACT

A toner composition includes toner particles including an average diameter ranging from about 3 μm to about 10 μm, an average particle density of about 1.4 g/cm$^3$ or less, and for a given particle size configured to have a decreased mass and reduced particle momentum. The toner particle can include one of a solid core and a solid outer shell, a porous core and a porous outer shell, and a solid outer shell with a hollow core. The porous and solid cores can include a low density material.

15 Claims, 4 Drawing Sheets

LOW DENSITY TONER FOR OPTIMAL IMAGE QUALITY AND PERFORMANCE LATITUDE

FIELD OF THE INVENTION

This invention relates generally to imaging and, more particularly, to a low density toner without reducing toner particle size and having optimal image quality and performance latitude.

BACKGROUND OF THE INVENTION

It has been previously appreciated that small toner particle size can provide an improvement in image quality (IQ) as well as reduced toner mass area (TMA) that can enable reduced differential gloss and lower run cost opportunity. However, small toner particles can be problematic, such as reduced developability, poor transfer efficiency and cleaning failures. Accordingly, there is interest in obtaining an image quality exemplified by the small toner particle, but using bigger particles in order to maintain improved machine performance latitude.

SUMMARY OF THE INVENTION

According to various embodiments, the present teachings include a toner composition comprising toner particles having an average diameter ranging from about 3 μm to about 10 μm. The toner particles can have an average mass density of about 1.4 g/cm$^3$ or less.

According to various embodiments, the present teachings also include a low density toner particle a diameter of about 3 μm to about 10 μm. The low density toner particle can have a mass density of about 1.4 g/cm$^3$ or less.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

Figure 1:
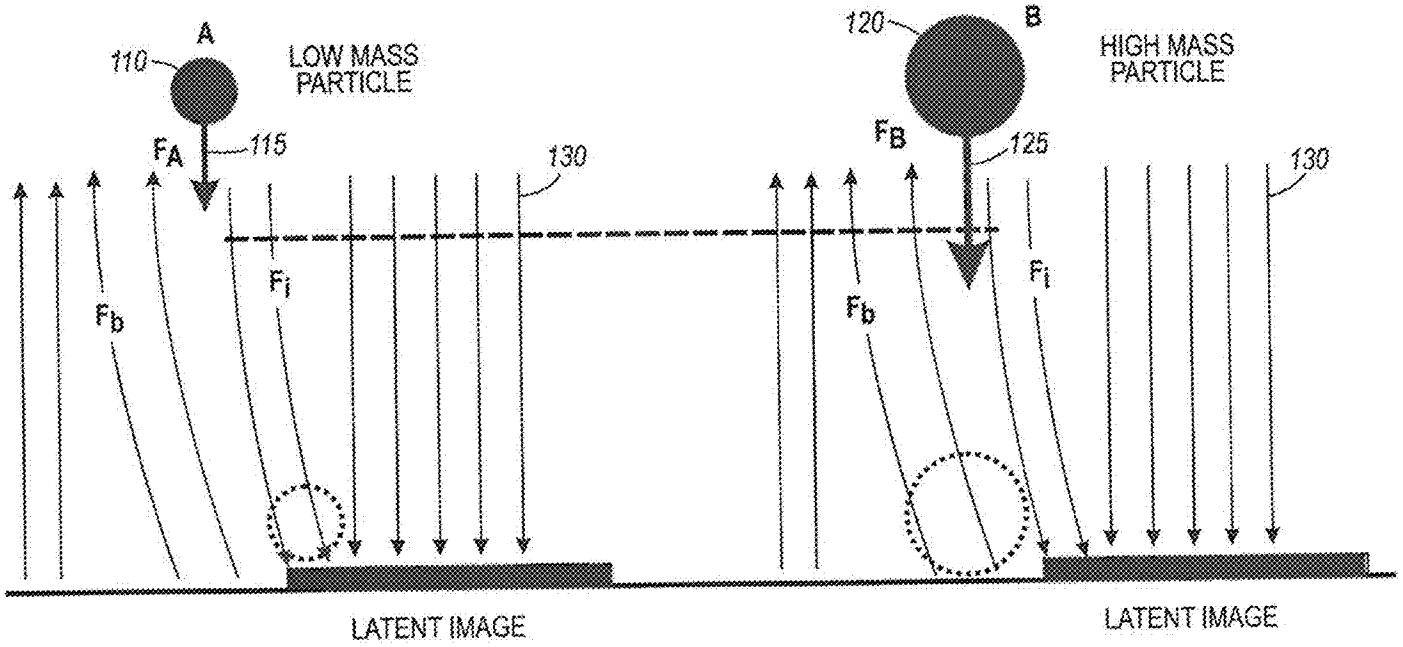
FIG. 1 is a schematic view depicting how particle momentum of a more massive particle leads to a misplaced particle in accordance with the present teachings.

It should be noted that some details of the figures have been simplified and are drawn to facilitate understanding of the inventive embodiments rather than to maintain strict structural accuracy, detail, and scale.

DESCRIPTION OF THE EMBODIMENTS

Reference will now be made in detail to the present embodiments (exemplary embodiments) of the invention, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, merely exemplary.

As used herein, the term "imaging" refers to any of conventional imaging such as ink jet, xerography, electrophotography, as known in the art.

As used herein, the term "porous" refers to a structure or material which has a plurality of pores that allow fluids or gasses to pass therethrough. Typically, the pores of a porous structure or material inherently include fluidic passageways therethrough according to the configuration of pores.

As used herein, the term "solid" refers to a structure or material which does not include a plurality of pores. However, some pores may be present as a result of normal polymerization reactions to produce the structure or material.

Decreasing toner particle size has previously been associated with improved image rendering and decreased specific mass usage. However, decreasing toner particle size is also associated with decreased xerographic control latitude. As will be further detailed in the following, exemplary embodiments are directed to a low density toner without a reduced toner particle size. The low density toner can obtain image quality equivalent to that of a smaller diameter toner by better following close range development fields related to accurate image rendering, while maintaining xerographic latitude.

Without being limited by theory, it is a premise herein that a low density toner particle will have a decreased mass, and therefore a decreased momentum. The advantage of decreased momentum is that it makes it easier for particles to closely follow electrostatic field lines, leading to more faithful image rendering. This extends, as well, to more highly defined and stable halftone dot rendition which results in reduced graininess and mottle. A low density toner matches the better image quality of small toner particles while realizing the transfer, cleaning and handling advantages of bigger particles.

Without being limited by theory, it is a further premise herein that image smoothness, e.g. sharper, better defined images, does not reside in toner size but in toner momentum. A typical toner particle diameter is about 10 to 20 times the size of a halftone dot, which is significantly beyond any resolution required for printing if the toner particles are positioned at the correct locations. It is believed that smaller toner particles provide better images because of their lower mass rather than their size. In the image development step of a xerographic process, toner gains momentum as it is accelerated by latent image electrical fields. The initial momentum gained by the toner may not be pointed in the correct direction because the electric field felt by the toner at a distance from the latent image is a mean field average—that is, the electric field felt by the toner at a distance is equivalent to a blurred image without detail resolution. As the toner approaches the latent image, the electric field lines help to guide ("steer") the toner toward the latent image areas. However, the electric force responsible for the precise placement of toner at the latent image depends on the toner charge alone and not on its mass as characterized by the following equation:

$$a = \frac{F}{m} = \frac{qE}{\frac{4}{3}\pi R^3 \rho}, \quad (1)$$

wherein a is the particle acceleration along the field line, F is the electric attraction force, m is the toner particle mass, q is the toner charge, E is the local electric field at the toner particle center, R is the toner radius and p is the toner density. Toner particles with larger masses have a higher initial momentum, possibly pointed in a wrong direction, which makes it difficult for the electric field to "steer" or accelerate the toner particle into the precise correct position on the latent image given the particular constraints of charge, space and field gradients. This characteristic is depicted in the simplified schematic in FIG. 1 where the momentum 115 of a low mass particle 110 is small compared to the momentum 125 of a larger, high mass particle 120. The force (e.g., the horizontal components of $F_i$, $F_b$ in FIG. 1) needed to steer the particle sideways is proportional to the mass of the particle. If the charge of both particles A 110 and B 120 are the same, the lighter particle (particle A 110) is more readily guided into position by the electrostatic field lines 130. It can be seen that the particle momentum 125 of higher mass particles 120 can lead to misplaced particles because the electrical force (e.g., $F_i$, $F_b$) is insufficient to guide more massive particles to follow the electrostatic field lines faithfully.

When toner is at a distance from the latent image, fine field details of the latent image are not distinguishable in the electrostatic field lines. In other words, a complicated design with complex fine field latent image patterns (e.g., Kanji characters) provides an essentially uniform electrical from far away; fine field details are indistinguishable to the toner from a distance. As represented by the field lines 130 at distance h in FIG. 2, the electrostatic field 210 is a uniform vertical field at a distance from the latent image. As toner particles approache their target position (latent image), the fine electric field pattern starts to be distinguishable and the electric forces start to spread the toner cloud and to accelerate the toner particles towards their target positions. For more massive toner particles, given the same charge, the acceleration (a=qE/m, where a, q, E, and m are as previously defined) can be insufficient to counter the particle's initial momentum and particles can be misplaced. This is shown in FIG. 2, which provides a simplified schematic depicting why fine latent image electric field patterns present a challenge to toner placement and, ultimately, to high image quality.

Figure 2:
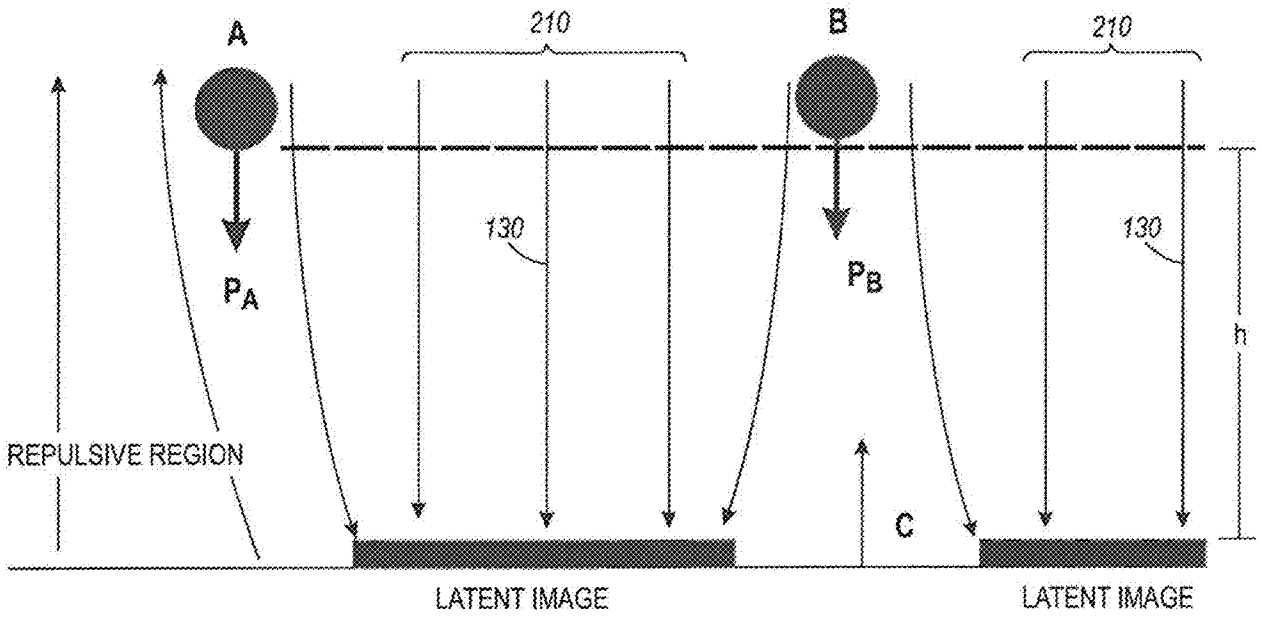
FIG. 2 is a schematic view depicting a finely detailed electric field pattern for particles A and B, in accordance with the present teachings.

In FIG. 2, as particles A and B travel toward the latent image, particle B 120 "sees" a flat plane potential and does not immediately feel the repulsive force from region C because the repulsive field of region C is shielded by the attractive field of the two latent image islands. Particle A 110, on the other hand, will "see" the pattern of the edge of the latent image because the repulsive region is not masked by the attractive field of an adjacent latent image. As the toner particles travel closer toward the photoreceptor and the fine electric field pattern starts to be distinguishable to particle B 120—that is, the repulsive force from region C is distinguishable from the attractive force of the latent image islands, particle B 120 has much shorter distance to react to a repulsive force than particle A 110 has. Therefore low particle momentum is desirable for faithful image development.

To further explain toner motion as it relates to complex latent images, In the development step of the xerographic process, the toner is attracted by the latent image and must be guided (e.g., forced oraccelerated) towards the right location on the latent image, i.e., towards the correct finely detailed latent halftone dots (HTD) or print character. The acceleration of a toner particle is given by:

$$a = \frac{F}{m} = \frac{qE}{\frac{4}{3}\pi R^3 \rho} = \frac{4\pi R^2 \sigma}{\frac{4}{3}\pi R^3 \rho} E = \frac{3\sigma}{R\rho} E \quad (2)$$

wherein s is the average charge density on the surface of the toner particle; ρ is the mass density of the toner; R is the toner radius; and E is the electric field guiding the toner to the latent image. As shown in Eq. (2), an equal percentage of reduction on R (toner radius) or on p (toner density) gives the same increase in the guiding acceleration to the latent image, increasing the print resolution by the same amount. Accordingly, for better print resolution, a reduction in toner mass is as relevant as a reduction in toner diameter.

While image quality improvements are certainly desirable, the operational challenges faced with smaller particles are many, leading to reduced performance latitude. This leads to transfer inefficiencies. Cleaning and developability also become less efficient for small-sized toner. These issues are due to increased particle adhesion from both electrostatic image force and Van der Waals forces. Additionally, smaller toner particles typically exhibit higher Q/M (electrical charge/mass) and reduced q/d (tribocharge/diameter) ratios, which lead to poor developability and excessive background, respectively.

FIGS. 3A through 3D depict exemplary toner particles 300 of a given size and having a reduced mass in accordance with the present teachings. It should be readily apparent to one of ordinary skill in the art that the toner particles 300 depicted in FIGS. 3A through 3D represent a generalized schematic illustration and that other components can be added or existing components can be removed or modified.

Figure 3A:
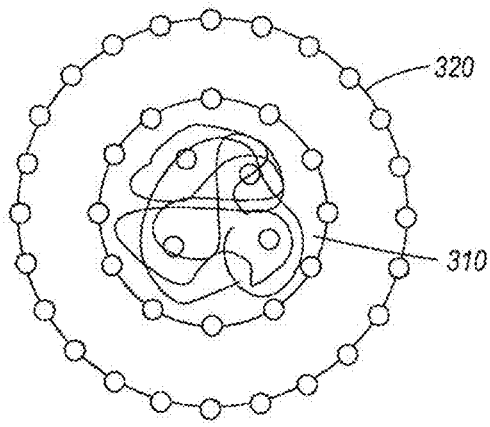
FIGS. 3A through 3D are schematic views of exemplary toner particles, in accordance with the present teachings.

As shown in FIG. 3A, the toner particle 300 can include a porous core 310 and a porous outer shell 320.

Figure 3B:
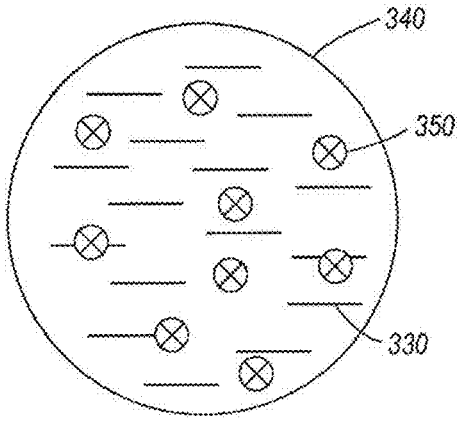

As shown in FIG. 3B, the toner particle 300 can include a core material 330 and a solid shell 340. The core material 330 can further include islands 350 of low density material. The low density material can be any material produced by any technique known in the art to lower effective polymer density including, but not limited to, dissolved gas, low density oils, low density polymers, materials having porous morphology, combinations thereof, and the like. The islands 350 of low density material can be discrete islands, with or without porosity therein.

Figure 3C:
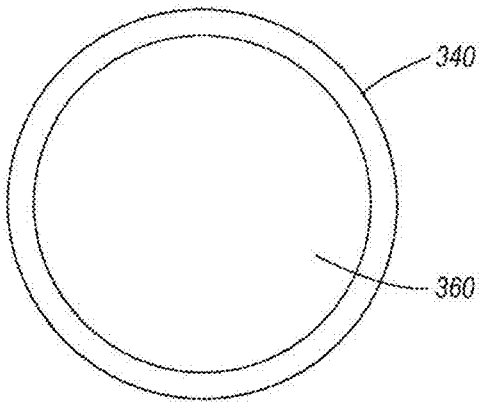

As shown in FIG. 3C, the toner particle 300 can include a hollow core 360 and a solid shell 340.

Figure 3D:
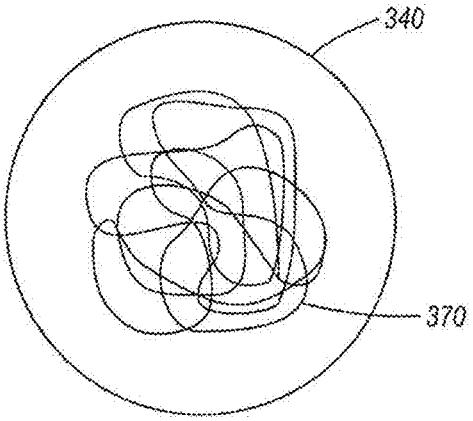

As shown in FIG. 3D, the toner particle 300 can include a low density core 370 and a solid shell 340. The low density core 370 can be of any composition capable of rendering the overall density of the toner particle 300 a lower density than a similarly sized toner particle without the low density core 370—for example, but not limited to, low density composite materials such as low density carbon nanocomposites, low density and very low density polyethylene resins, polybutyls, polymethylpentene, ethylene-propylene and other polymers as further discussed later herein. In embodiments, the low density composite material is continuously distributed (i.e., not as discrete islands) throughout the low density core 370.

If pores are present in the toner particles, the pores can be nanopores or micropores with average pore diameters ranging from about 1 nm to about 2 μm in diameter, or about 10 nm to about 1 μm in diameter, such as about 100 nm to about 500 nm in diameter. The shape of the pores can be spherical or irregular. The porosity can be obtained by chemical polymerization reaction, where gas or vapor bubbles are used to form gas or vapor-filled voids ("pores") in the polymerized toner core. In embodiments, the porosity of the toner particles can range from about 1% to about 80%, or from about 2% to about 50%, such as about 10% to about 30%.

In embodiments, the low density toner of the present disclosure may include any latex resin suitable for use in forming a toner. Such resins, in turn, may be made of any suitable monomer. Suitable monomers useful in forming the resin include, but are not limited to, acrylonitriles, diols, diacids, diamines, diesters, diisocyanates, combinations thereof, and the like. Any monomer employed may be selected depending upon the particular polymer to be utilized.

In embodiments, the polymer utilized to form the resin may be a polyester resin. Suitable polyester resins include, for example, sulfonated, non-sulfonated, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid or diester in the presence of an optional catalyst. For forming a crystalline polyester, suitable organic diols include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), polypropylene-adipate), poly(butylene-adipate), poly(pentylene-adipate), poly (hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly (nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof. The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 500 to about 50,000, in embodiments from about 500 to about 20,000, and a weight average molecular weight (Mw) of, for example, from about 1000 to about 20,000 as determined by Gel Permeation Chromatography using polystyrene standards. The molecular weight distribution (Mw/Mn) of the crystalline resin may be, for example, from about 2 to about 6, in embodiments from about 3 to about 4.

Examples of diacid or diesters selected for the preparation of amorphous polyesters include dicarboxylic acids or anhydrides or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include amorphous polyester resins. Exemplary amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly(propoxylated bisphenol A co-fumarate)-copoly(propoxylated bisphenol A co-terephthalate), a terpoly(propoxylated bisphenol A co-fumarate)-terpoly(propoxylated bisphenol A co-terephthalate)-terpoly-(propoxylated bisphenol A co-dodecylsuccinate), and combinations thereof. In embodiments, the amorphous resin utilized in the core may be linear.

In embodiments, a suitable amorphous polyester resin may be a copoly(propoxylated bisphenol A co-fumarate)-copoly(propoxylated bisphenol A co-terephthalate) resin having the following formula (I):

(I)

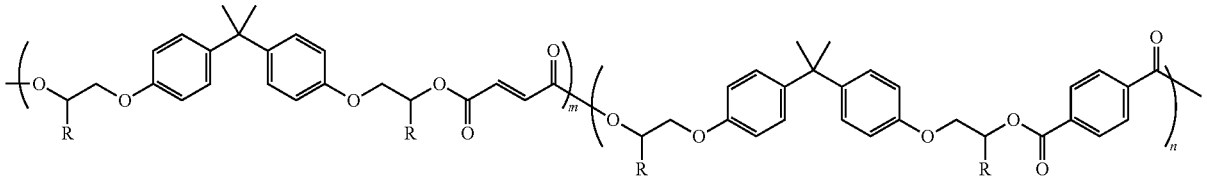

wherein R may be hydrogen or a methyl group, and m and n represent random units of the copolymer and m may be from about 2 to 10, and n may be from about 2 to 10. Other suitable resins include one of the terpolyesters set forth below in Formula (II)

(II)

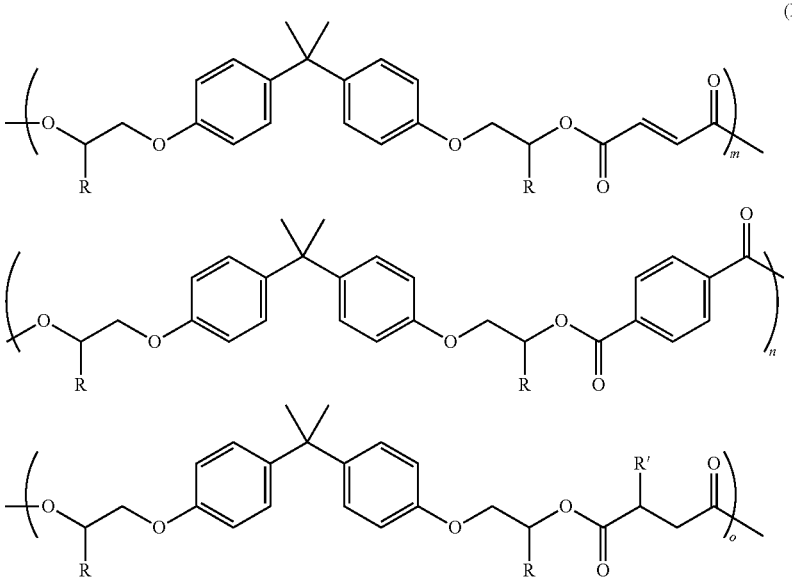

wherein R is hydrogen or a methyl group, R' is an alkyl group from about 2 to about 20 carbon atoms, and m, n and o represent random units of the copolymer and m may be from about 2 to 10, n may be from about 2 to 10, and o from about 2 to about 10.

An example of a linear copoly(propoxylated bisphenol A co-fumarate)-copoly(propoxylated bisphenol A co-terephthalate) which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

(III)

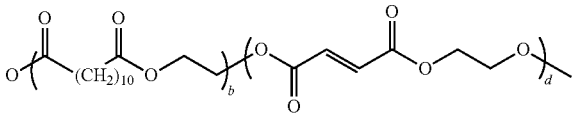

wherein b is from about 5 to about 40 and d is from about 7 to about 20.

In embodiments, a suitable crystalline resin utilized in a toner of the present disclosure may have a number average molecular weight of from about 500 to about 3,000, in embodiments from about 1000 to about 2,000.

One, two, or more resins may be used in forming a toner. In embodiments where two or more resins are used, the resins may be in any suitable ratio (e.g., weight ratio) such as, for instance, from about 1% (first resin)/99% (second resin) to about 99% (first resin)/1% (second resin), in embodiments from about 10% (first resin)/90% (second resin) to about 90% (first resin)/10% (second resin).

As noted above, in embodiments, the resin may be formed by emulsion aggregation methods. Utilizing such methods, the resin may be present in a resin emulsion, which may then be combined with other components and additives to form a toner of the present disclosure.

The polymer resin may be present in an amount of from about 65 to about 95 percent by weight, such as from about 75 to about 85 percent by weight of the toner particles (that is, toner particles exclusive of external additives) on a solids basis. In embodiments when a crystalline resin is used, the ratio of crystalline resin to amorphous resin can be from about 1:99 to about 30:70, such as from about 5:95 to about 25:75, in some embodiments from about 5:95 to about 15:95. Other components such as waxes may be present in an amount from about 5 to about 25% by weight.

The resins described above, in embodiments a combination of polyester resins, for example a low molecular weight amorphous resin and a crystalline resin, may be utilized to form toner compositions. Such toner compositions may include optional colorants, waxes, and other additives. Such toner compositions may include a low density material. In embodiments, the low density material may be in an emulsion including any latex resin described above. Toners may be formed utilizing any method within the purview of those skilled in the art including, but not limited to, emulsion aggregation methods. Non-limiting examples of a low density material include dissolved gas, such as air, carbon dioxide, nitrogen dioxide, nitrogen or any other suitable gas or vapor; low density oils such as mineral oil, silicone oil, isoparaffinic hydrocarbons and the like; low density polymers such as polybutylene, polymethylene, ethylene-propylene, and low density polyethylene resins; materials having porous morphology such as polymers, as controlled by the polymerization process parameters; minerals or ceramics with porosities determined by their manufacturing processcombinations thereof, and the like. The low density material may be present in the toner in an amount ranging from about 1% by weight to about 80% by weight of the toner particles, depending on the type of material used, for example from about 2% by weight to about 50% by weight, such as from about 10% by weight to about 30% by weight. The low density material can form discrete islands within the toner particle thereby lowering the density of the toner particle even further. For example, if dissolved gasses are used, the dissolved gasses may form voids (pores) within the resultant toner particle. As another example, if low density oils and/or polymers are used, the oils and/or polymers may form discrete islands of low density material within the resultant toner particle.

If colorant is added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKST™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions. For the present disclosure the lower density pigments are preferred.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE REDT™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI-74160, CI Pigment Blue, Pigment Blue 15:3, and Anthrathrene Blue, identified in the Color Index as CI-69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like, with preference to low density or porous pigment particles.

Specific examples of pigments include SUNSPERSE 6000, FLEXIVERSE and AQUATONE water based pigment dispersions from SUN Chemicals, HELIOGEN BLUE L6900™, D6840™, D7080™, D7020N, PYLAM OIL BLUEN, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI-74160, CI Pigment Blue, Pigment Blue 15:3, and Anthrathrene Blue, identified in the Color Index as CI-69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

The toner particles may be prepared by any method within the purview of one skilled in the art. Although embodiments relating to toner particle production are described below with respect to emulsion aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

The growth, shaping and morphology of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

In embodiments, an optional shell ("shell" or "shell resin") may be applied to the formed aggregated toner particles ("core" or "core resin"). Any resin described above as suitable for the core resin may be utilized as the shell resin. The shell resin may be applied to the aggregated particles by any method within the purview of those skilled in the art. In embodiments, the shell resin may be in an emulsion including any surfactant described above. In aspects, an emulsion including the shell resin may optionally include any low density material described above. The aggregated particles described above may be combined with said emulsion so that the resin forms a shell over the formed aggregates. In embodiments, an amorphous polyester may be utilized to form a shell over the aggregates to form toner particles having a core-shell configuration. In embodiments, a low molecular weight amorphous resin may be utilized to form a shell over the formed aggregates. In further embodiments, if a low density material is utilized, the shell formed over the aggregates may be porous. For example, if dissolved gasses are used, the dissolved gasses may form voids (pores) in the shell. If a low density material is not utilized, the shell formed over the aggregates may be solid, i.e., non-porous.

The shell resin may be present in an amount of from about 5 percent to about 32 percent by weight of the toner particles, in embodiments from about 10 percent to about 30 percent by weight of the toner particles.

In embodiments, the reduced toner particle can contain a wax such as polyethylene wax, polymethylene wax, polypropylene wax, polybutene wax, sumacs wax, jojoba oil, beeswax, montan wax, ozokerite, ceresin, paraffin wax, microcrystalline wax, Fischer-Tropsch wax, stearyl stearate, behenyl behenate, butyl stearate, propyl oleate, glyceride monostearate, glyceride distearate, pentaerythritol tetra behenate; diethyleneglycol monostearate, dipropyleneglycol distearate, and combinations thereof; wherein the at least one wax is present in an amount from about 1% to about 10% by weight of the toner.

The low density toner can be obtained by choice of the polymers and processes, as desdribed above, and similar processes within the purview of those skilled in the art.

In the embodiments described, the toner composition can have toner particles having an average diameter size in the range of about 3 μm to about 10 μm, for example from about 5 μm to about 7 μm in diameter, and for a given particle size configured to have a decreased mass and particle momentum proportional to toner density.

In embodiments, the toner particles can have an average mass density of about 1.4 g/cm$^3$ or less, or about 0.8 g/cm$^3$ or less. The particle can include voids (pores) created by, for example, use of gas or vapor dissolved in toner formulation preparation. The dissolution of gas or vapor during the polymerization process can be done under pressure, such as about 10 to about 2000 atmospheres, where the gas or vapor—such as, but not limited to, oxygen, nitrogen, carbon dioxide, and the like, or combinations thereof—is used as a dissolved impurity or initiator. Alternatively, the toner polymerization process can be conducted at atmosphere pressure or below atmosphere pressure.

In various embodiments, low density toner particles achieve improved image rendering via low mass particles, while retaining particle handling control afforded for larger diameter particles. This is applicable both for improved image quality and reduced run cost.

Accordingly, low density toner materials offer the opportunity to achieve the image quality benefits of small toner particles, due to reduced particle mass, without the compromise in xerographic performance that is typical of small diameter toner. For a given particle size, the mass and therefore the particle momentum will decrease proportional to the toner density.

In embodiments, there is provided a method of controlling the electrostatic behavior of a toner particle comprising reducing the particle density for a given particle size. That is, the toner particle's density is reduced without reducing the overall particle size. The toner particle density can be reduced by any of the techniques discussed above including, but not limited to, creating air voids within the toner particle by utilizing dissolved gas or gasses in toner formulation preparation, utilizing islands of lower density material in the toner core, utilizing a low density composite material in the toner core, and the like.

By examining the balance of forces on a toner particle using the Feng-Hays toner adhesion equation [Eq. (3)] significant influence due to particle size can be observed. The first term on the right-hand side of the equation is the electrostatic driving force. The second term (showing the $R^2$ value in the denominator) represents the electrostatic image adhesion term. The third term represents the adhesion force term (describing toner adhesion due to polarization (e.g., dipole interactions)) and tends to be less in magnitude than the image force terms. The $F_{NE}$ is the short range non-electrostatic term (or van der Waals term) and is inversely proportional to the particle radius dimension to the sixth power ($R^6$).

$$F_{TONER} = \beta QE - \alpha\frac{Q^2}{16\pi R^2\varepsilon_0} - \gamma\pi\varepsilon_0 R^2 E^2 - F_{NE}(1/R^6) \tag{3}$$

By maintaining particle size, the image forces and the short range (Van der Waals) forces can be reduced significantly as compared to that of reduced diameter (small-sized) toner particles. Further, the ratio for q/d to Q/M (given as $\pi\rho D^2/6$, wherein ρ is as defined above and D is the toner diameter) is strongly affected by the particle size but is only linearly influenced by the particle density. Understanding these particle characteristics can inform toner design and allow robust operating latitude by tailoring the apparent density of the toner particle.

Besides reaching small toner image quality levels without the small toner issues, low density toners can provide lower fuser power needed due to lower thermal mass of low density toner; provide lower fused pile heights if the low density composition is obtained by using a high air or gas-content resin formulation; and provide potentially reduced external surface additive requirements over that of small diameter particles because of lower adhesion forces associated with low density toner.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

Other embodiments of the invention will be apparent to those skilled in the art from consideration of the specification and practice of the invention disclosed herein.

It is intended that the specification and examples be considered as exemplary only, with a true scope and spirit of the invention being indicated by the following claims.

What is claimed is:

1. A toner composition comprising:

toner particles comprising an average diameter ranging from about 3 μm to about 10 μm, wherein the toner particles have an average mass density of 0.8 g/cm$^3$ or less, wherein the toner particle comprises a configuration selected from one of the following:

a) a core surrounded by a shell, the core and the shell each comprising a resin independently selected from the group consisting of amorphous resins, crystalline resins, low density composite materials, and combinations thereof, the core further comprising a low density material that is different from the resin of the core, the low density material being selected from the group consisting of dissolved gas, low density oils, low density polymers and combinations thereof, wherein if the low density material is a dissolved gas, the dissolved gas is not air; or b) a shell comprising a first material and a core comprising a second material, the second material selected from the group consisting of carbon nanocomposites, porous minerals and porous ceramics, the second material having a lower density than the first material.

2. The toner composition of claim 1, wherein the toner particles comprise an average diameter ranging from about 5 μm to about 7 μm.

3. The toner composition of claim 1, wherein the shell is porous and the core is porous.

4. The toner composition of claim 3, wherein the toner particle has a porosity ranging from about 1% to about 80%.

5. The toner composition of claim 1, wherein the a) configuration is selected, and the low density material is present as discrete islands within the toner particle.

6. A low density toner particle comprising:

a diameter of about 3 μm to about 10 μm; and a mass density of 0.8 g/cm$^3$ or less wherein the toner particle comprises a configuration selected from one of the following:

a) a core surrounded by a shell, the core and the shell each comprising a resin independently selected from the group consisting of amorphous resins, crystalline resins, low density composite materials, and combinations thereof, the core further comprising a low density material that is different from the resin of the core, the low density material being selected from the group consisting of dissolved gas, low density oils, low density polymers and combinations thereof, wherein if the low density material is a dissolved gas, the dissolved gas is not air; or b) a solid shell comprising a first material and a core comprising a second material, the second material selected from the group consisting of carbon nanocomposites, porous minerals and porous ceramics, the second material having a lower density than the first material.

7. The low density toner particle of claim 6, wherein the toner particle comprises a porous core and a porous shell.

8. The low density toner particle of claim 7, wherein the pores have an average diameter ranging from about 1 nm to about 2 μm.

9. The low density toner particle of claim 6, wherein the a) configuration is selected, and the low density material is present as discrete islands within the core.

10. A toner composition comprising:

toner particles comprising an average diameter ranging from about 3 μm to about 10 μm, wherein the toner particles have an average mass density of 0.8 g/cm$^3$ or less, the toner particles comprising a core surrounded by a shell, the core and the shell each comprising a resin independently selected from the group consisting of amorphous resins, crystalline resins, low density composite materials, and combinations thereof, the core further comprising a low density material that is different from the resin of the core, the low density material being selected from the group consisting of dissolved gas, low density oils, low density polymers and combinations thereof, wherein if the low density material is a dissolved gas, the dissolved gas is not air.

11. The composition of claim 10, wherein the low density material is present as discrete islands within the core.

12. The toner composition of claim 1, wherein the shell is solid and the core is porous.

13. The toner composition of claim 1, wherein the toner particle has configuration b).

14. The low density toner particle of claim 6, wherein the toner particle has configuration a).

15. The low density toner particle of claim 6, wherein the toner particle has configuration b).

* * * * *